United States Patent [19]

Gage

[11] 4,013,387

[45] Mar. 22, 1977

[54] OIL WELL PUMP

[76] Inventor: Lonnie L. Gage, Rte. 3, Walters, Okla. 73572

[22] Filed: Jan. 2, 1974

[21] Appl. No.: 429,546

Related U.S. Application Data

[63] Continuation of Ser. No. 264,786, June 21, 1972, abandoned.

[52] U.S. Cl. ..... 417/554

[51] Int. Cl.[2] ..... F04B 21/04

[58] Field of Search ..... 277/173; 417/545, 554; 92/158, 160

[56] References Cited

UNITED STATES PATENTS

| | | | |
|---|---|---|---|
| 654,316 | 7/1900 | Lewis | 417/554 |
| 1,060,622 | 5/1913 | Owen | 277/173 |
| 1,588,705 | 6/1962 | Cope et al. | 417/545 |
| 1,777,959 | 10/1930 | Budlong | 277/173 |
| 1,785,834 | 12/1930 | Kilgore | 417/554 |
| 2,590,245 | 3/1952 | Harbison | 277/173 |
| 2,745,660 | 5/1956 | Delahay | 277/173 |
| 3,168,052 | 2/1965 | Pate | 417/554 |
| 3,586,464 | 12/1969 | Crowe | 417/554 |

*Primary Examiner*—William L. Freeh
*Attorney, Agent, or Firm*—Head, Johnson & Chafin

[57] ABSTRACT

An oil well subsurface pump comprising a plunger reciprocally disposed within a working barrel and having check valve means carried thereby. Piston rings are provided on the outer periphery of the plunger for engaging the inner periphery of the working barrel during reciprocation of the plunger which preclude bypassing of the plunger by the well fluid and permit an efficient pumping action upon each stroke of the pump without slippage.

5 Claims, 4 Drawing Figures

OIL WELL PUMP

CROSS REFERENCE TO RELATED APPLICATION

This application is a continuation of my copending application Ser. No. 264,786, now abandoned filed June 21, 1972 and entitled "Oil Well Pump".

BACKGROUND OF THE INVENTION

1. Field of the Invention

This invention relates to improvements in oil well pumps and more particularly, but not by way of limitation, to a reciprocal plunger type pump.

2. Description of the Prior Art

In producing oil wells it is common practice to provide a pump at the bottom of the well bore or at least down the well bore in the producing formation. The pump is normally actuated by reciprocating of the pump plunger by sucker rods which extend through the well bore from a reciprocating device at the surface of the ground and into connection with the pump. The reciprocating device at the surface is usually a horsehead type pump and laternately raises and lowers the string of sucker rods in the well bore. Subsurface pumps have long presented many problems in lifting of the well fluid to the surface of the ground. For example, most pumps presently available have an inner barrel or plunger two and one half feet to eight feet long which cause friction and drag and it is necessary to load the pump by the weight of the rods pushing down on the plunger. If the plunger does not move freely, the plunger may not have a full stroke thus reducing pumping efficiency. In addition, many of the subsurface pumps have slippage in the operation of the plunger and require several strokes of the pump before a sufficient load is applied to the pump for starting the pumping action. Also, many well fluids contain sand and other foreign particles which greatly hinder the operation of the subsurface pump and frequently damage the working parts thereof. The pumping of heavy, viscous fluids also presents a problem to the usual subsurface pump available today.

SUMMARY OF THE INVENTION

The present invention contemplates a novel subsurface pump for oil wells which is particularly designed and constructed for overcoming the above disadvantages. The novel pump is of a simple and efficient design wherein a reciprocal plunger or piston is disposed within a working barrel, with suitable check valve means carried by the plunger for admitting the well fluid to the interior thereof during reciprocation of the plunger. The plunger is suitably connected with the usual sucker rods for reciprocation within the working barrel. The plunger is preferably only nine to twelve inches long with a central bore of approximately one and one sixteenth inch diameter. Thus, the pump will load freer and friction and drag will be reduced. Piston rings are disposed around the outer periphery of the plunger and engage the inner periphery of the working barrel during reciprocation of the plunger for precluding bypassing of the plunger by the well fluid. The piston rings are of the split a snap ring type utilized on automobile pistons wherein the rings have a concentric inner and outer periphery. The design of these automobile piston rings is such that they are constantly urged radially outward to provide an efficient sealing even upon wear of the rings. This assures a quick and efficient loading of the pump whereby pumping action is produced with the initial stroke of the plunger and the pump will pump approximately twenty percent more fluid. Thus, viscous well fluids as well as sandy well fluids may be efficiently elevated to the surface of the ground by the novel pumping apparatus.

DESCRIPTION OF THE PREFERRED EMBODIMENTS

Figure 1:
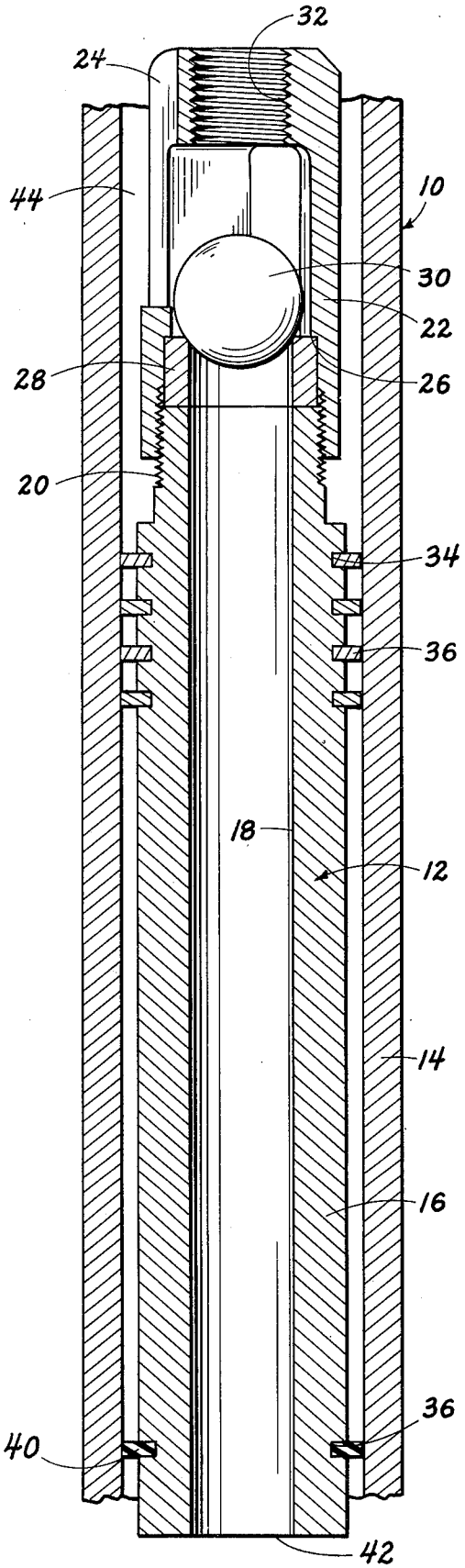
FIG. 1 is a sectional elevational view of a subsurface pump embodying the invention.

Preferring to the drawings in detail, and particularly FIG. 1, reference character 10 generally indicates a subsurface pump comprising a plunger assembly 12 reciprocally disposed within a working barrel 14. The working barrel 14 is preferably set within a well tubing (not shown) by a suitable packer (not shown) or the like as is well known, and in such a manner that the pump 10 is disposed in the proximity of or within a producing formation (not shown) of the well bore (not shown). The plunger assembly 12 may be connected with suitable sucker rods (not shown) in any well known manner, such as a coupling member (not shown) suitably connected with the upper end of the plunger assembly 12 for reciprocation thereof within the working barrel 14 to provide the pumping action for the pump 10 as is well known.

The plunger assembly 12 comprises a main sleeve or housing 16 having a central bore 18 extending longitudinally therethrough to provide a fluid passageway. The sleeve 16 is preferably between nine to twelve inches long and the central bore 18 is preferably approximately 1 1/16 inch in diameter. The upper end of the sleeve 16 is threaded at 20 for receiving a cage member 22 thereon. The cage member 22 may be of any suitable type and as shown herein is provided with a plurality of circumferentially spaced slots or openings 24 providing communication between the interior and exterior thereof. An inwardly directed annular shoulder 26 is provided on the inner periphery of the cage 22 for bearing against a ring or sleeve 28 which is disposed against the upper end of the body 16. The ring 28 provides a valve seat for a ball member 30 disposed within the cage and movable therein in response to pressure differentials acting thereon, as is well known in ball-type check valves. The upper or outer end of the cage 22 is provided with a central bore 32 extending longitudinally therein and which is preferably threaded as shown in FIG. 1. The threaded bore 32 may be connected with the lowermost sucker rod (not shown) or may be connected with a suitable coupling member (not shown) which in turn is connected with the lowermost sucker rod of the sucker rod string (not shown).

A plurality of longitudinally spaced grooves are provided on the outer periphery of the sleeve or body 16 for receiving piston rings 36 therein. It will be apparent that substantially any number of the piston rings 36 may be provided, as desired, and as required in accordance with the overall length of the plunger assembly 12 and operating conditions for the pump 10. The piston rings 34 are preferably of the split or snap ring type normally used in connection with automobile pistons and are of a size for wiping or engaging the inner periphery of the working barrel 14 during reciprocation of the plunger assembly 12, as will be hereinafter set forth. It is to be noted that whereas the rings 36 depicted in the drawings comprise a single relatively wide ring in each of the grooves 34, it is usually preferable to provide a sufficient number of narrow rings in order to make a tighter packing with less friction than a smaller number of wider rings. For example, two narrow rings in each groove may be found to provide better results than one wide ring. In addition, whereas the grooves 34 may be spaced along the entire length of the sleeve or body 16, the embodiment shown in FIG. 1 discloses grooves 34 spaced relatively close together in the proximity of the upper end of the body 16.

As hereinbefore set forth, the piston rings 36 are preferably of the type normally used in connection with automobile pistons which are usually metallic and constructed in a manner for being constantly urged radially outwardly. For example, the rings 36 such as might be utilized with a one and one half inch diameter plunger, and as purchased from a manufacturer, may be identified as follows: 1 × 500 × 124 × 1225 × 063 × 073 step cut 5/32 inch step and a similar ring 36 such as might be utilized with a two inch diameter plunger and as purchased from a manufacturer may be identified as follows:

2000 × 124 × 1225 × 080 × 090 step cut 5/32 inch step.

With regard to the ring for the one and one half inch diameter plunger, the identifications set forth above may be interpreted as follows:

1 × 500 indicates that the ring is for use with a piston having a diameter of one and one half inches.

124 indicates with width of the ring, in thousandths of an inch.

1225 indicates the depth of the ring, in thousandths of an inch.

063 indicates the clearance between the internal diameter of the ring and the bottom of the ring groove in thousandths of an inch.

073 indicates the clearance between the internal diameter of the ring and the bottom of the groove, in thousandths of an inch, when the ring is in compression.

Step cut indicates that the ring is provided with overlapping type ends of a step cut configuration.

5/32 inch step indicates that the dimension of the step at the ends of the ring is 5/32 inch, indicating the overall dimension of expansion for the ring before a complete separation between the ends occurs (in this instance, the ring ends can move through a combined distance of 5/16 inch before complete separation of the ring ends occurs.)

In addition, these rings usually have a 0.013 inch compression factor, which means that the ring will function efficiently until it has become worn sufficiently to reduce its outer dimensions by more than 0.013 inch.

It will be apparent that a similar analysis may be made of the identification of the ring 36 for the piston having a two inch diameter.

During operation of an automobile engine, it is considered that the engine lubricating oil circulates around the piston rings during reciprocation of the pistons within the cylinders. The lubricating oil is thought to flow through the slight clearance between the internal diameter of the rings and the bottom of the ring groove, thus filling the area therebetween and upon compression of the rings, the oil in the groove provides an additional pressure for forcing the rings radially outward into an efficient sealing engagement with the walls of the cylinder in which the piston is reciprocating. It is considered that this same action occurs during use of the pump 10, which may account for the extremely improved results with the use of the pump.

In addition, it is to be noted that automobile piston rings, such as the rings 36 are regular rings, as indicated in the drawings, as opposed to any eccentric configuration. This means that the internal bore of the rings is circular and not elongated or oval and concentric with the outer circumference thereof. This assures that the plunger 12 will be efficiently maintained in a "centered" or concentric position within the working barrel 14 during reciprocation of the plunger therein.

An annular groove 38 is provided around the outer periphery of the body 16 spaced below the grooves 34 and preferably in the proximity of the lower end of the sleeve 16 for receiving a suitable wiper ring 40 therein. The wiper ring 40 is preferably constructed from a suitable flexible material, such as rubber, neoprene, or the like, for wiping the inner periphery of the working barrel 14 during reciprocation of the plunger assembly 12.

The lower end of the sleeve 16 is open as shown at 42 and in communication with the fluid reservoir (not shown) provided in the well tubing (not shown) or in the well bore (not shown) above the usual standing valve (not shown). The standing valve is normally provided in the well tubing (not shown) below the working barrel 14 and is in communication with the fluid to be produced from the well bore, as is well known.

In operation, the working barrel 14 is set in the well tubing (not shown) in the proximity of the producing formation in any well known manner, and preferably above the standing valve (not shown). The pump plunger assembly 12 is reciprocated within the working barrel 14 by the normal sucker rods (not shown) in the usual manner. On the upstroke of the plunger assembly 12, a suction is created in the well tubing above the standing valve for opening the standing valve and pulling a quantity of the well fluid into the interior of the well tubing. It will also be apparent that the ball 30 will be urged against the valve seat 28 upon the upstroke of the plunger assembly 12 for closing of the ball check valve. On the downstroke of the plunger assembly 12 the fluid in the well tubing will enter the bore 18 of the sleeve 16 and the pressure of the fluid will raise the ball 30 from the valve seat 28 for opening of the ball valve (sometimes called a travelling valve). The well fluid will move through the open valve and through the slots 24 of the cage 22 for discharge into the working barrel above the sleeve 16. Of course, continued reciprocation of the plunger assembly 12 causes the fluid within the working barrel 14 to rise therein, and suitable ports (not shown) are provided in the working barrel 14 for directing the fluid into the interior of the well tubing above the pump 10, as is well known in this type of pumping apparatus.

Of course, the piston rings 36 move against the inner periphery of the working barrel 14 during reciprocation of the plunger assembly 12 in much the same manner as the piston rings of an automobile piston in the cylinders. As hereinbefore set forth the internal bore of the rings is concentric with the outer circumference thereof. The rings are thus disposed in concentric relation with the plunger 12 and the bore of the working barrel 14. The structure of the rings causes a constant outward pressure of the outer circumference thereof to sealingly engage the inner periphery of the working barrel. The engagement of the piston rings 36 with the inner periphery of the working barrel 14 precludes any leakage of the well fluid between the sleeve 16 and the working barrel 14 whereby each stroke of the pump plunger assembly 12 delivers fluid into the working barrel above the plunger assembly with substantially no slippage between the plunger and the working barrel. In addition, the wiper ring 38 wipes the inner periphery of the working barrel 14 during reciprocation of the plunger assembly 12.

Figure 2:
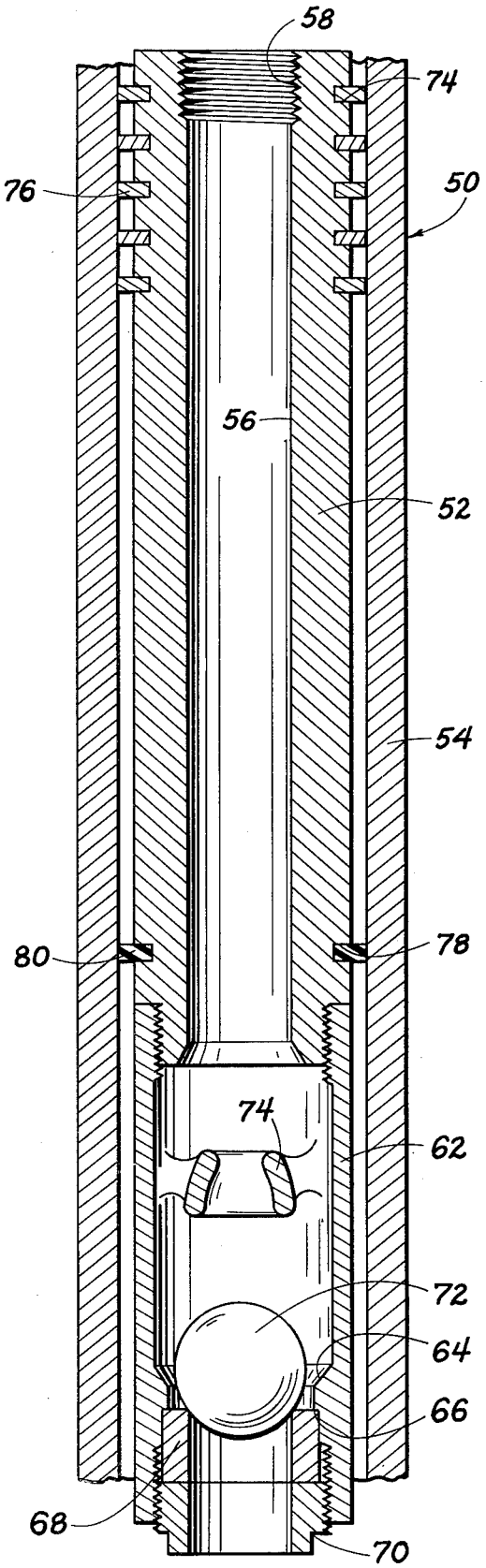
FIG. 2 is a view similar to FIG. 1 showing a modified subsurface pump embodying the invention.

Referring now to FIG. 2, a similar subsurface oil well pump is generally indicated at 50. The pump 50 comprises a sleeve or housing 52 reciprocally disposed within a working barrel 54. The working barrel 54 is preferably set within the well tubing (not shown) in the manner as hereinbefore set forth, with the pumping apparatus 50 being disposed in the proximity of the producing formation in the well bore. The sleeve 52 is provided with a longitudinally extending central bore 56 providing a fluid passageway therethrough. The upper end of the bore 56 is preferably provided with a threaded portion 58 for connection with the lowermost sucker rod (not shown), or for connection with a suitable coupling member (not shown) which in turn is connected with the lowermost sucker rod, as hereinbefore set forth.

The lower end of the sleeve 52 is threaded as shown at 60 for receiving a sleeve member 62 thereon. An inwardly and downwardly directed shoulder 64 is provided on the inner periphery of the sleeve 62 spaced below the sleeve 52 and an inwardly directed shoulder 66 is spaced below the shoulder 64 for bearing against the upper end of an insert ring 68 which serves as a valve seat. A retainer sleeve 70 is threadedly secured to the lower end of the sleeve 62 for retaining the ring 68 in position against the shoulder 66. A ball member 72 is loosely disposed within the sleeve 62 and cooperates with the valve seat 68 for providing alternate open and closed positions for the valve. A spider member or web member 74 is provided on the inner periphery of the sleeve 62 interposed between the lower end of the sleeve 52 and the valve seat 68 for limiting the upward movement of the ball 72 during operation of the pump 50.

A plurality of longitudinally spaced annular grooves 74 similar to the grooves 34 are provided on the outer periphery of the sleeve 52 in the proximity of the upper end thereof for receiving piston rings 76 therein similar to the rings 36. The rings 36 engage the inner periphery of the working barrel 54 during reciprocation of the sleeve 52 therein as hereinbefore set forth. In addition, an annular groove 78 similar to the groove 38 is provided on the outer periphery of the sleeve 52 in the proximity of the lower end thereof for receiving a wiper ring 80 therein. The wiper ring 80 is similar to the wiper ring 40 and wipes the inner periphery of the working barrel 54 during reiprocation of the sleeve 52 therein.

In operation, the working barrel 54 is set in the well tubing (not shown) in the proximity of the producing formation, with the usual standing valve (not shown) being provided in the well tubing below the working barrel 54 and in communication with the fluid to be produced from the well bore as hereinbefore set forth. The sleeve 52 is connected with the lowermost sucker rod (not shown) as hereinbefore set forth whereby the sleeve 52 may be reciprocated within the working barrel 54 by the sucker rods in the usual manner. On the upstroke of the sleeve 52, a suction is created in the well tubing above the standing valve for opening thereof and pulling a quantity of the well fluid into the interior of the well tubing. It will be apparent that the ball 72 is urged against the valve seat 68 on the upstroke of the sleeve 52 for closing the ball valve. On the downstroke of the sleeve 52 the pressure of the fluid in the well tubing raises the ball 72 from the valve seat 68 for opening the valve (often referred to as a travelling valve) whereby the well fluid is introduced into the interior of the sleeve 52. Of course, continued reciprocation of the plunger sleeve 52 causes the fluid within the sleeve 52 to rise therein for filling the sleeve and for discharge thereabove.

It will be apparent that the sleeve 52 may be secured to the lower end of a string of hollow sucker rods, if desired, and in this event, the well fluid will be delivered upwardly through the hollow sucker rod string for production of the fluid. If solid type sucker rods are utilized, it will be necessary to interpose a suitable ported coupling (not shown) between the sleeve 52 and the lowermost sucker rod whereby the fluid will be discharged from the interior of the sleeve 52 into the working barrel 54 above the sleeve 52.

As hereinbefore set forth, the piston rings 76 engage the inner periphery of the working barrel 54 in much the same manner as the piston rings of an automobile engine engage the cylinder walls. The piston rings 76 assure that no well fluid will bypass the sleeve 52, thus providing an efficient pumping action for the pump 50.

Figure 3:
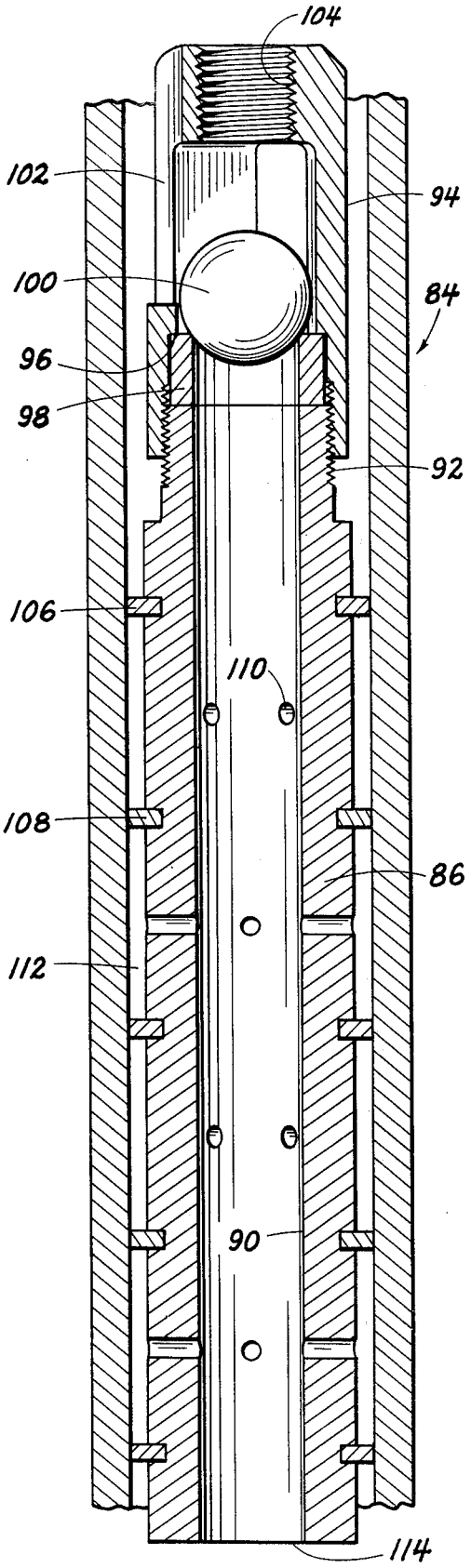
FIG. 3 is a view similar to FIG. 1 showing another modified subsurface pump embodying the invention.

Referring to FIG. 3, a subsurface pump generally indicated at 84 is depicted which is generally similar to the pump 10. The pump 84 comprises a sleeve or housing 86 reciprocally disposed within a working barrel 88. The sleeve 86 is provided with a longitudinally extending central bore 90 providing a fluid passageway therethrough. The upper end of the sleeve 86 is threaded at 92 for receiving a cage member 94 similar to the cage 22. An inwardly directed annular shoulder 96 is provided on the inner periphery of the cage 94 for bearing against a ring or insert member 98 which is disposed on the upper end of the sleeve 86 which provides a valve seat. A ball 100 is loosely disposed within the cage 94 and cooperates with the insert member or valve seat 98 for providing alternate open and closed positions for the valve. The cage 94 is provided with a plurality of circumferentially spaced slots or ports 102 for communication between the interior and exterior thereof. In addition, a centrally disposed longitudinally extended threaded bore 104 is provided in the upper end of the cage 94 for connection with the lowermost sucker rod (not shown) or for connection with a suitable coupling member (not shown) which in turn is connected with the lowermost sucker rod.

A plurality of annular grooves 106 are provided on the outer periphery of the sleeve 86 for receiving piston rings 108 therein. The rings 108 are similar to the rings 34 and engage the inner periphery of the working barrel during reciprocation of the sleeve 86 as hereinbefore set forth. The grooves 106 are preferably spaced throughout the entire length of the sleeve 86 and may be at substantially any desired spacing therebetween. A spacing of approximately one and one half inches between the grooves 106 has been found to provide efficient operation of the pump 84. If desired, a plurality of circumferentially spaced ports or bores 110 may be provided in the sidewalls of the sleeve 86, with each set of bores 110 being interposed between adjacent pairs of rings 108. In this manner, a small portion of the well fluid being moved upwardly through the bore 90, as will be hereinafter set forth, will be directed to the annular space 112 between the sleeve 86 and the working barrel 88 to provide lubrication for the piston rings 108.

The lower end of the sleeve 86 is open as shown at 114 and is in communication with the fluid accumulation area in the well tubing (not shown) or well bore (not shown) above the standing valve (not shown). Of course, the lowermost ring 108 may be a wiping ring, if desired, as hereinbefore set forth.

The operation of the pump 84 is substantially identical with the operation of the pump 10, with the exception that a small portion of the well fluid being pumped through the bore 90 will be directed into the annular space 112 for additional lubrication of the piston rings during reciprocation of the sleeve 86.

Figure 4:
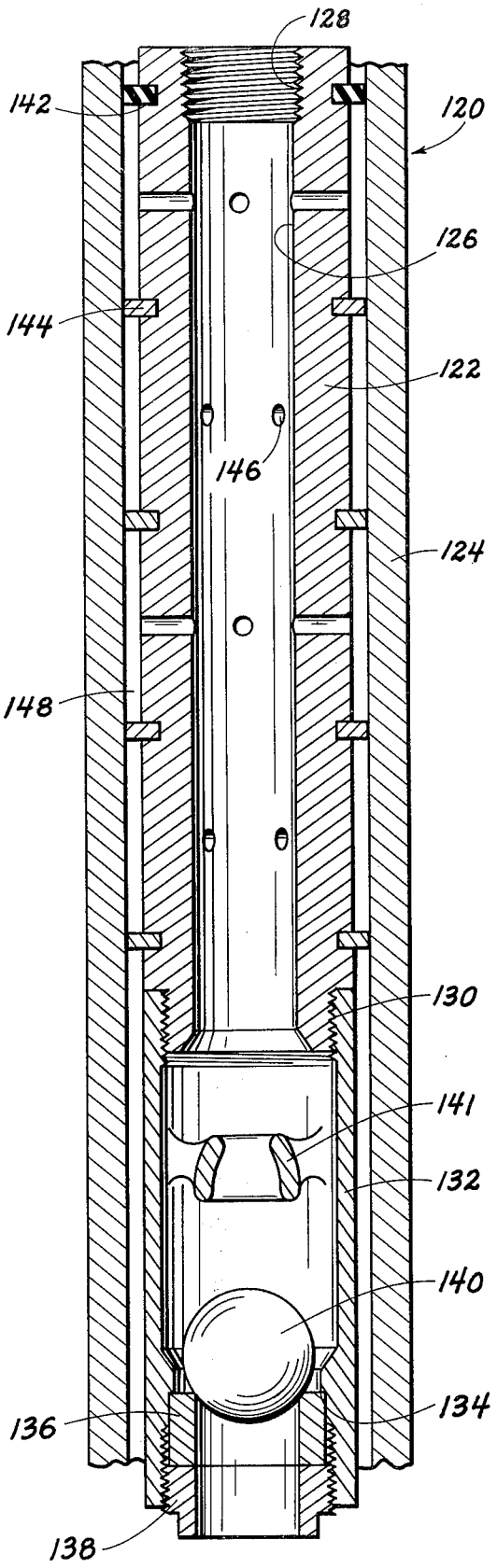
FIG. 4 is a view similar to FIG. 1 showing still another modified subsurface pump embodying the invention.

Referring now to FIG. 4, a pump generally indicated at 120 is depicted which is similar to the pump 50. The pump 120 comprises a sleeve 122 reciprocally disposed within a working barrel 124. The sleeve 122 is provided with a longitudinally extending central passageway 126 providing a fluid passageway therethrough. The upper end of the bore 126 is preferably threaded as shown at 128 for connection with the lowermost sucker rod (not shown) or for connection with a suitable coupling member (not shown) which in turn is connected with the lowermost sucker rod.

The lower end of the sleeve 122 is threaded at 130 for receiving a sleeve member 132 thereon. The sleeve 132 is similar to the sleeve 62 and is provided with an inwardly directed shoulder 134 which bears against the upper end of a ring member 136 which functions as a valve seat for the pump 120. A retainer sleeve 138 is threadedly connected to the lower end of the sleeve 132 for retaining the valve seat 136 securely therein. A ball member 140 is loosely disposed in the sleeve 132 and cooperates with the seat member 136 to provide alternate open and closed positions for the valve. A web or spider member 141 is provided on the inner periphery of the sleeve 132 and interposed between the insert ring 132 and the sleeve 122 for limiting the upward movement of the ball 140 during operation of the valve 120.

A plurality of longitudinally spaced annular grooves 142 are provided on the outer periphery of the sleeve 122 and preferably are spaced along the entire length thereof for receiving piston rings 144 therein, as hereinbefore set forth. Whereas the grooves 142 may be disposed at substantially any desired spacing therebetween, a spacing of approximately one and one half inches between the grooves 142 has been found to provide efficient results. A plurality of circumferentially spaced ports or bores 146 are provided in the sidewalls of the sleeve 122 with a set of the bores 146 being interposed between adjacent pairs of rings 144. In this manner a small portion of the fluid moving through the bore 126 during operation of the pump 120 will be directed to the annular space 148 between the sleeve 122 and working barrel 124 for lubrication of the rings 144. Of course, the operation of the pump 120 is substantially identical with the operation of the pump 50 as hereinbefore set forth.

Whereas the particular embodiments depicted herein disclose a stationary working barrel and a reciprocal internal plunger, it is to be understood that the internal plunger may be stationary while the outer barrel is reciprocated, as is well known in bottom hole or subsurface pumps of this type.

From the foregoing it will be apparent that the present invention provides a novel subsurface pump for producing oil wells wherein a simple reciprocal plunger member is disposed within the working barrel. The usual travelling valve or check valve is carried by the plunger for facilitating admitting of the well fluid from the fluid reservoir in the well bore to the interior of the tubing string, or to the interior of the hollow sucker rod string, for advancing the well fluid to the surface of the ground. Piston rings similar to the piston rings of an automobile engine are provided around the outer periphery of the plunger for engaging the inner periphery of the working barrel during operation of the pump. The piston rings preclude leakage or bypassing of the well fluid between the plunger and the working barrel for providing an efficient pumping action on each stroke of the plunger. The novel pump is simple and efficient in operation and economical and durable in construction.

Whereas the present invention has been described in particular relation to the drawings attached hereto, it should be understood that other and further modifications, apart from those shown or suggested herein, may be made within the spirit and scope of this invention.

What is claimed:

1. A subsurface well pump comprising a first elongated stationary tubular member in communication with the well fluid reservoir, a second elongated tubular member in communication with the well fluid and concentrically arranged with respect to the stationary tubular member and reciprocal with respect thereto, valve means carried by one of said tubular members to provide alternate open and closed positions for the pump during operation thereof, and piston ring means provided on the outer periphery of one of said tubular members and engagable with the inner periphery of the other of said tubular members for precluding bypassing of the well fluid between the tubular members during operation of the pump, said piston ring means comprising at least one annular groove provided around the outer periphery of said one tubular member, at least one relatively thi metallic piston ring disposed in said groove, said ring having an internal bore concentric with the outer circumference thereof and being constantly urged in an outwardly radial direction for sealing engagement with the inner periphery of the said other tubular member, and wherein a slight clearance is provided between the internal bore of said piston ring and the bottom of each annular groove, a portion of said well fluid being trapped in said clearance to facilitating maintaining of said ring concentric with said groove and increase the sealing engagement of the ring and said other tubular member.

2. A subsurface well pump as set forth in claim 1 and including wiper ring means provided on the outer periphery of one of said tubular members and engageable with the inner periphery of the other of said tubular members for wiping thereof during operation of the pump.

3. A subsurface well pump as set forth in claim 1 wherein the piston ring means includes a plurality of longitudinally spaced annular grooves provided on the outer periphery of said one of said tubular members, and at least one of said piston rings being disposed in each of said annular grooves for engaging the inner periphery of the other of said tubular members.

4. A subsurface well pump as set forth in claim 1 wherein a plurality of said piston rings are disposed in said annular groove.

5. A subsurface well pump as set forth in claim 1 and including a plurality of circumferentially and longitudinally spaced bores provided in the sidewalls of the plunger for directing a small portion of the well fluid between the plunger and working barrel for additional lubrication of the plunger during reciprocation thereof.

* * * * *